US005449890A

United States Patent [19]

van Neck

[11] Patent Number: 5,449,890

[45] Date of Patent: Sep. 12, 1995

[54] SLIDE CALCULATOR WITH LINER

[76] Inventor: Serge O. van Neck, 16621 E. Jacklin Dr., Fountain Hills, Ariz. 85268

[21] Appl. No.: 248,443

[22] Filed: May 24, 1994

[51] Int. Cl.[6] ..... G06G 1/02

[52] U.S. Cl. ..... 235/70 R

[58] Field of Search ..... 235/70 R, 70 A, 70 B, 235/70 C, 70 D, 79.5, 84

[56] References Cited

U.S. PATENT DOCUMENTS 3,747,847 7/1973 Cohen ..... 235/70 R 4,028,529 6/1977 Van De Weghe ..... 235/70 R

*Primary Examiner*—Steven L. Stephan

*Assistant Examiner*—Cassandra C. Spyrou

*Attorney, Agent, or Firm*—Cahill, Sutton & Thomas

[57] ABSTRACT

A slide calculator includes a sleeve having a plurality of windows for presenting data from three variables arranged in matrices of rows and columns. Opposite sides of the sliding card include data with the rows and columns interchanged. The sleeve surrounding the sliding card is lined with a transparent plastic.

3 Claims, 1 Drawing Sheet

SLIDE CALCULATOR WITH LINER

BACKGROUND OF THE INVENTION

This invention relates to a calculator for selectively displaying a table of data and, in particular, to a calculator having a plastic liner to facilitate movement of a slide through the calculator wherein the slide has dissimilar data on the opposite sides thereof.

In the prior art, one type of calculator includes a sliding or rotating card having a table of data printed thereon and viewable through a mask which encloses the card. Such calculators are available for a wide variety of applications, e.g. loan amortization or fill-in exposure for photographic flash. Such calculators do not actually calculate a result but display selected portions of a table or matrix of data previously calculated.

Such data is typically in the form of an independent variable displayed as rows having a particular increment or step between rows, e.g. payments in increments of twenty dollars, and a dependent variable displayed in columns, e.g. accumulated savings. The data for several variables may be displayed simultaneously in several windows, e.g. payment, interest, and number of payments.

Viewing a large table of numbers can be confusing and lead to error. In order for the tables of data to be more easily read by a user, a plurality of windows are provided in a sleeve or mask which overlies the card. For financial applications, there are many ways to present financial data for a consumer. Also, in order for the data to be useful, the incremental change between each piece of data in the table is necessarily small, requiring a large table. Thus, the same kind of data is presented on both the front side and the back side of a card.

A calculator for displaying tables of data is frequently used as a promotional item, for example by banks or other financial institutions, and is typically made from card stock which wears rapidly with use. Also, the card is often difficult to move within a sleeve. It is desired to make a calculator with a feel of higher quality and greater durability.

In view of the foregoing, it is therefore an object of the invention to provide a calculator including a sleeve and a movable slide wherein the slide is protected by a transparent, plastic lining in the sleeve.

Another object of the invention is to provide a financial calculator in which dissimilar data is printed on the reverse sides of a card, thereby enhancing the analysis of the situation modeled by the data.

SUMMARY OF THE INVENTION

The foregoing objects are achieved in this invention in which a slide calculator includes a sleeve having a plurality of windows for presenting data from three variables on a sliding card. Opposite sides of the sliding card present data from different dependent variables. The sleeve surrounding the sliding card is lined with a transparent plastic which facilitates movement of the card, minimizes wear, and gives the calculator a more substantial, higher quality feel.

BRIEF DESCRIPTION OF THE DRAWINGS

A more complete understanding of the invention can be obtained by considering the following detailed description in conjunction with the accompanying drawings in which.

DETAILED DESCRIPTION OF THE INVENTION

Figure 1:
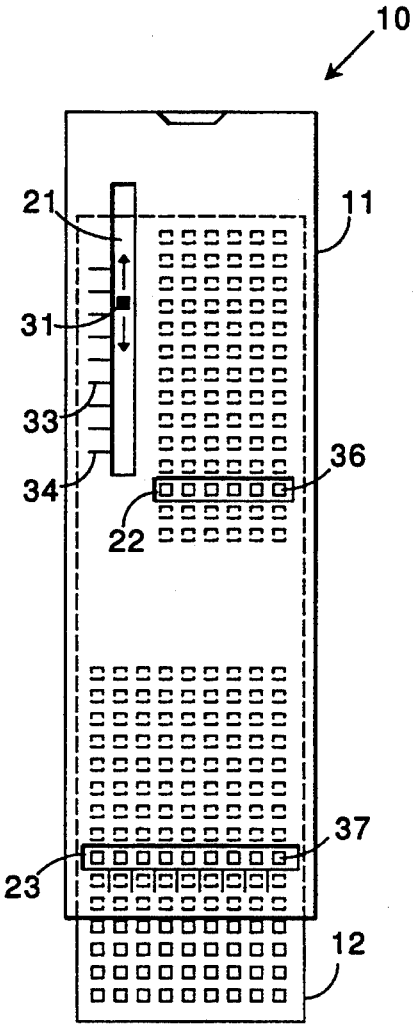
FIG. 1 (PRIOR ART)
FIG. 1 is a front view of a calculator from the prior art.
Figure 2:
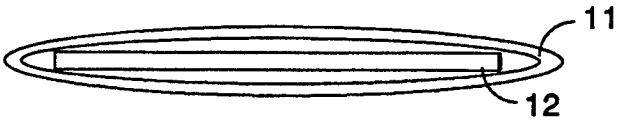
FIG. 2 (PRIOR ART)
FIG. 2 is an end view of a calculator from the prior art.

Referring to FIGS. 1 and 2, calculator 10 includes sleeve 11 surrounding card 12 which is relatively free to move longitudinally within sleeve 11. Sleeve 11 includes a plurality of windows, such as windows 21, 22, and 23. Window 21 reveals marker 31 which moves up and down within window 21 and aligns with a plurality of indicia, such as indicia 33 or indicia 34. When suitably aligned, a row of data, such as row 36, is aligned with window 22 and another row of data, such as row 37 is aligned with window 23. Row 36 is one row from a first table of data and row 37 is one row from a second table of data. Two or three variables can be presented by calculator 10. For example, marker 31 can be aligned with text designating a particular interest rate, window 22 can show the amounts of monthly payments for different periods, and window 23 can show different principals for the same periods as window 22. Thus, data for two dependent variables are shown.

Calculator 10, typically constructed of card stock, is frequently used as a promotional item, for example by banks or other financial institutions. As a promotional item subjected to occasional use, the simple construction illustrated in FIGS. 1 and 2 is convenient and inexpensive. However, card 12 does not slide within sleeve 11 particularly easily and the calculator is quickly worn.

Figure 3:
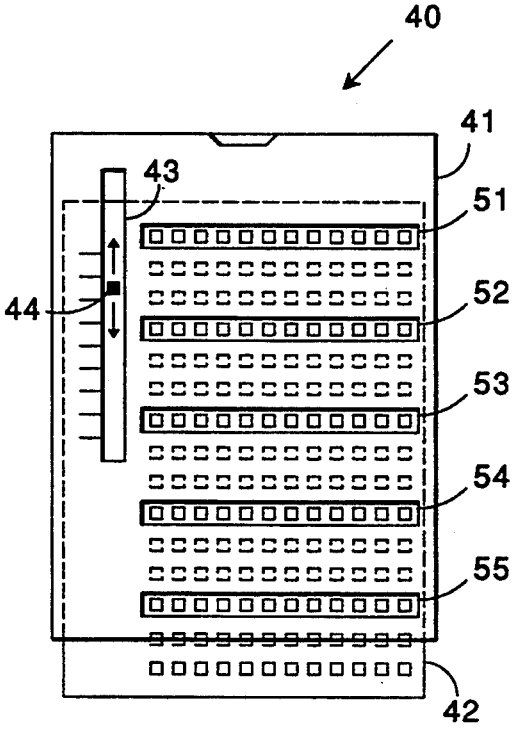
FIG. 3 illustrates a calculator constructed in accordance with the invention.
Figure 4:
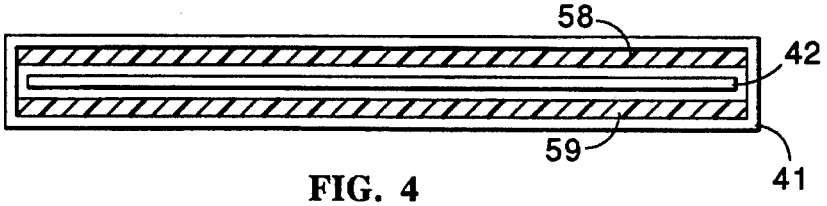
FIG. 4 is an end view of a calculator constructed in accordance with the invention.

FIGS. 3 and 4 illustrate a preferred embodiment of a calculator constructed in accordance with the invention in which the calculator conveys a better impression of substance and quality. Calculator 40 includes sleeve 41 and card 42 movable longitudinally through sleeve 41. Sleeve 41 includes a key to align the data including window 43 through which marker 44 is visible on card 42. Sleeve 41 includes a plurality of windows, shown as windows 51-55, through which selected rows of data on card 42 are visible. As illustrated in FIG. 4, sleeve 41 includes a transparent, plastic liner shown as sheets 58 and 59. Card 42, illustrated in FIG. 4 as separated slightly from sheets 58 and 59, actually touches the sheets and slides readily between the sheets.

As illustrated in FIG. 3, sleeve 41 includes a plurality of windows corresponding to incremental values of a first variable, e.g. payment per month. Each window provides access to a different matrix of data. One row of each matrix corresponds to a particular increment of a second variable selected by the key, i.e. by marker 44 in window 43. Each item of data in a row corresponds to an incremental change in a third variable, e.g. the number of payments. Thus, the data for three variables are shown.

In accordance with the invention, the back side of sleeve 41 has the same number and location of windows as the front side, but card 42 has the independent and dependent variables reversed on opposite sides thereof, i.e. the data is "inverted." For example, the data items arrayed in rows on one side of card 42 are arrayed in columns on the other side of card 42, and vice-versa. By inverting the data, one can often better analyze a situation modeled by the data.

The data items themselves are not simply rearranged, the data is re-calculated. For example, paying an extra $100 per month (independent variable) might shorten the period of a loan by 5.9 years (dependent variable) but "5.9" is not an available increment for period on the reverse side of the card. On the reverse side of the card, the dependent variable is the payment and is re-calculated using the nearest available increment of period, e.g. 6 years, the independent variable. The inverted chart would show a goal of shortening a mortgage by 6 years being met by paying an extra $99 per month.

If one side of card 42 displays the size of the monthly payment to amortize a loan in a given period, then the reverse side displays the period to amortize the loan for a given payment. Thus, the consumer is provided with different ways to consider data but without overwhelming the consumer because only limited amounts of the data are shown at a given time. Interchanging rows and columns on opposite sides of the card is not limited to the matrix shown in FIG. 3. The data from the key (window 43) can be switched with a row or column in the matrix of data items.

Having thus described the invention, it will be apparent to those of skill in the art that various modifications can be made within the scope of the invention. For example, additional cards can be provided for a single sleeve, wherein the additional cards are based upon yet other variables, e.g interest rate. While a preferred embodiment has been described in the context of a financial calculator, it is understood that any other data can be advantageously displayed using a calculator constructed in accordance with the invention; for example, weights and measures in English and metric units. While illustrated in FIG. 3 as having data vertically oriented, the data can be oriented horizontally instead.

What is claimed is:

1. A slide calculator comprising:

a card having a front side and a back side and having calculated data printed on said front side and on said back side, wherein said data is arranged in a matrix of rows and columns on said front side and is arranged in a matrix of columns and rows on said back side;

a sleeve enclosing said card, wherein said card can move longitudinally through said sleeve;

a first plastic sheet attached to said sleeve and extending between said front side and said sleeve; and a second plastic sheet attached to said sleeve and extending between said back side and said sleeve.

2. The slide calculator as set forth in claim 1 wherein said sleeve has a front side and a back side and wherein said front side and said back side include n windows and said data is arranged into n matrices, wherein n is an integer greater than zero.

3. The slide calculator as set forth in claim 1 wherein said sleeve further includes a first key on said front side and a second key on said back side.

* * * * *